US011454349B2

(12) United States Patent
Houel et al.

(10) Patent No.: US 11,454,349 B2
(45) Date of Patent: Sep. 27, 2022

(54) FACILITY FOR STORING AND TRANSPORTING A LIQUEFIED GAS

(71) Applicant: GAZTRANSPORT ET TECHNIGAZ, Saint Remy les Chevreuse (FR)

(72) Inventors: Pierre Houel, Saint Remy les Chevreuse (FR); Sébastien Delanoe, Saint Remy les Chevreuse (FR); Sébastien Corot, Saint Remy les Chevreuse (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 170 days.

(21) Appl. No.: 16/965,984

(22) PCT Filed: Feb. 5, 2019

(86) PCT No.: PCT/FR2019/050252
§ 371 (c)(1),
(2) Date: Jul. 29, 2020

(87) PCT Pub. No.: WO2019/155154
PCT Pub. Date: Aug. 15, 2019

(65) Prior Publication Data

US 2020/0355324 A1 Nov. 12, 2020

(30) Foreign Application Priority Data

Feb. 7, 2018 (FR) ..... 1851035

(51) Int. Cl.
*F17C 3/02* (2006.01)
*F17C 13/00* (2006.01)

(52) U.S. Cl.
CPC ..... *F17C 3/027* (2013.01); *F17C 13/001* (2013.01); *F17C 2203/0358* (2013.01);
(Continued)

(58) Field of Classification Search
CPC .... F17C 3/00; F17C 3/02; F17C 3/027; F17C 13/00; F17C 13/001; F17C 2203/0631;
(Continued)

(56) References Cited

U.S. PATENT DOCUMENTS 3,021,808 A 2/1962 Henry

FOREIGN PATENT DOCUMENTS

CN 107270115 A 10/2017
FR 1174820 3/1959
(Continued)

OTHER PUBLICATIONS

Search Report dated Oct. 8, 2021 issued in corresponding CN Application No. 2019800417735 dated Feb. 5, 2019.
(Continued)

*Primary Examiner* — Lars A Olson
(74) *Attorney, Agent, or Firm* — Blank Rome LLP

(57) ABSTRACT

The invention relates to an installation for storing and transporting a liquefied gas, having a sealed pipe (7) that passes through the tank wall so as to define a fluid passage between the inside and the outside of the tank, a sealed metal sheath (29) that is disposed around the sealed pipe (7) and fitted in the opening (22) in the load-bearing wall, the sealed sheath having a longitudinal portion extending at least as far as the sealing membrane (14), the sealing membrane being joined to the sealed sheath (29) in a sealed manner, wherein the load-bearing structure comprises a coaming (24) that protrudes from an outer surface of the load-bearing wall, the sealed pipe being supported by a top wall (26) of the coaming, the sealed sheath (29) having an outer end that is disposed outside the load-bearing wall and attached to the coaming or to the sealed pipe (7) all around the sealed pipe.

20 Claims, 5 Drawing Sheets

(52) U.S. Cl.
CPC ..... *F17C 2203/0631* (2013.01); *F17C 2221/033* (2013.01); *F17C 2223/0161* (2013.01); *F17C 2270/0107* (2013.01)

(58) Field of Classification Search
CPC ..... F17C 2221/033; F17C 2223/0161; F17C 2270/0107
USPC ..... 114/74 A
See application file for complete search history.

(56) References Cited

FOREIGN PATENT DOCUMENTS

| | | | | |
|---|---|---|---|---|
| FR | 2691520 | | 5/1992 | |
| FR | 2861060 | | 10/2003 | |
| GB | 579840 | | 8/1946 | |
| KR | 20140088975 | | 7/2014 | |
| RU | 2047813 | C1 | 11/1995 | |
| RU | 2489304 | C1 | 8/2013 | |
| SU | 900070 | C1 | 1/1982 | |
| WO | WO-2013093261 | | 12/2011 | |
| WO | WO-2014128381 | | 2/2013 | |
| WO | WO-2015155377 | A1 * | 10/2015 | ..... F17C 3/025 |
| WO | WO-2016120540 | | 6/2016 | |
| WO | WO 2017216477 | | 12/2017 | |

OTHER PUBLICATIONS

International Search Report of International Application No. PCT/FR2019/050252.
CA Russian Search Report dated Apr. 4, 2022.

* cited by examiner

FACILITY FOR STORING AND TRANSPORTING A LIQUEFIED GAS

RELATED APPLICATIONS

The present application is a national stage of International Application No. PCT/FR2019/050252, filed Feb. 5, 2019, which claims priority to French Patent Application No. 1851035, filed Feb. 7, 2018, both of which are incorporated herein by reference.

TECHNICAL FIELD

The invention relates to the field of sealed and thermally insulating membrane-type tanks for storing and/or transporting a liquefied gas, and in particular tanks carried on board ships or other floating structures.

The tank(s) may be intended to transport a large cargo of liquefied gas and/or to receive liquefied gas used as fuel for propelling the ship.

TECHNOLOGICAL BACKGROUND

Ships for transporting liquefied natural gas have a plurality of tanks for storing the cargo. The liquefied natural gas is stored in these tanks, at atmospheric pressure, at around −162° C. and is thus in a liquid-vapor two-phase state of equilibrium such that the heat flux applied through the walls of the tanks tends to cause the liquefied natural gas to evaporate.

In order to avoid the generation of overpressures inside the tanks, a tank of a methane tanker is associated with a pipe for evacuating the vapor, referred to as a gas dome, which is arranged in the ceiling wall of the tank, generally at the centerline of the ship, and connected to the main vapor collector of the ship and to a riser mast. The vapor thus collected can then be transferred to a re-liquefying facility in order that the fluid can then be reintroduced into the tank, to energy production equipment or to a riser mast provided on the deck of the ship.

A gas dome structure suitable for a tank wall having a bonded composite membrane is described in particular in the publication WO-A-2013093261 or WO-A-2014128381. However, these structures exhibit large dimensions and are fairly complex.

SUMMARY

An idea underlying the invention is to propose a relatively simple structure for passing a sealed pipe into a sealed and thermally insulating membrane-type tank, in particular a small-diameter pipe that can be used to collect or inject liquid or vapor.

According to one embodiment, the invention provides an installation for storing and transporting a liquefied gas, the installation having:

a load-bearing structure having a load-bearing wall provided with an opening, a sealed and thermally insulating tank incorporated in said load-bearing structure, said sealed and thermally insulating tank having a tank wall mounted on an inner surface of the load-bearing wall, the tank wall having at least one thermally insulating barrier and at least one sealing membrane that are superposed in a thickness direction of the tank wall, a sealed metal pipe that is fitted in the opening in the load-bearing wall and passes through the tank wall parallel or obliquely to said thickness direction so as to define a fluid passage between the inside and the outside of the tank, a sealed metal sheath that is disposed around the sealed pipe and fitted in the opening in the load-bearing wall, the sealed sheath having a longitudinal portion extending parallel to the sealed pipe through the thickness of the thermally insulating barrier at least as far as the sealing membrane, the sealing membrane having an opening through which the sealed pipe passes and being joined to the sealed sheath in a sealed manner all around said opening, wherein the load-bearing structure comprises a coaming that protrudes from an outer surface of the load-bearing wall and is disposed around the sealed pipe, the sealed pipe being supported by a top wall of the coaming, the longitudinal portion of the sealed sheath having an outer end that is disposed outside the load-bearing wall and attached to the top wall of the coaming or to the sealed pipe in a sealed manner, all around the sealed pipe.

By virtue of these features, the sealed pipe can be passed through the sealed and insulating tank wall in a simple and reliable manner, without putting the sealing of the tank wall at risk. In particular, the transmission of mechanical loads between the load-bearing wall and the sealing membrane can be very substantially limited by the presence of the sealed sheath and of the coaming.

According to embodiments, such an installation may have one or more of the following features.

The or each sealed sheath can be fixed to the load-bearing structure in various ways, directly or indirectly. According to one embodiment, the outer end of the sealed sheath is attached to the top wall of the coaming. According to one embodiment, the longitudinal portion of the sealed sheath constitutes a lateral wall of the coaming, the longitudinal portion of the sealed sheath being welded to the load-bearing wall around the opening in the load-bearing wall, the top wall of the coaming being fixed to the outer end of said longitudinal portion. According to one embodiment, the sealed sheath also has a support ring that is fixed at the outer end of the longitudinal portion of the sealed sheath and extends radially toward the inside of the sealed sheath, the support ring having an inner edge attached to the sealed pipe all around the sealed pipe.

Preferably in this case, the support ring is disposed in the coaming, in particular in an outer half of the coaming.

According to one embodiment, the sealing membrane is a metal membrane that is welded to the sealed sheath in a sealed manner by way of a flanged ring. According to one embodiment, the metal membrane has a series of parallel corrugations spaced apart at a regular pitch, the opening in the sealing membrane through which the sealed pipe passes having dimensions smaller than the regular pitch and being disposed in a flat region of the metal membrane between two corrugations. According to embodiments, such a metal membrane may be the only sealing membrane of the tank, for example for an LPG tank, or a primary membrane of a tank have a plurality of sealing membranes. In the latter case, an annular space situated between sealed sheath the sealed pipe may be in communication with the interior space of the tank.

According to one embodiment, the tank wall has a primary sealing membrane intended to be in contact with the liquefied gas, a secondary sealing membrane arranged between the primary sealing membrane and the load-bearing wall, a secondary thermally insulating barrier arranged between the secondary sealing membrane and the load-bearing wall, and a primary thermally insulating barrier arranged between the secondary sealing membrane and the primary sealing membrane. In this case, the sealed sheath may serve to join the primary sealing membrane or the secondary sealing membrane. It is also possible to provide a secondary sealed sheath to join the secondary sealing membrane and a primary sealed sheath for joining the primary sealing membrane.

According to one embodiment, said sealed metal sheath has a connecting plate extending in the region of the secondary sealing membrane all around the longitudinal portion of the sealed sheath, the secondary sealing membrane having a composite ply bonded to the connecting plate in a sealed manner all around the opening in the secondary sealing membrane.

According to one embodiment, a filling of insulating material is arranged in a gap between the longitudinal portion of the sealed sheath and the sealed pipe.

According to one embodiment, the primary sealing membrane has an opening for the sealed pipe to pass through, an edge of said opening being joined to the sealed pipe in a sealed manner all around the sealed pipe.

According to one embodiment, said sealed metal sheath is a secondary sealed sheath and the installation also has a primary sealed metal sheath that is disposed around the sealed pipe between the sealed pipe and the secondary sealed sheath, the primary sealed sheath having a longitudinal portion extending parallel to the sealed pipe through the thickness of the thermally insulating barrier at least as far as the primary sealing membrane, the sealing membrane having an opening through which the sealed pipe and the primary sealed sheath pass and being joined to the primary sealed sheath in a sealed manner all around said opening.

According to one embodiment, a filling of insulating material is arranged in a gap between the longitudinal portion of the secondary sealed sheath and the longitudinal portion of the primary sealed sheath.

According to one embodiment, the longitudinal portion of the primary sealed sheath has an outer end that is disposed outside the load-bearing wall and attached to the top wall of the coaming or to the sealed pipe in a sealed manner, all around the sealed pipe. According to one embodiment, the primary sealed sheath also has a primary support ring that is fixed at the outer end of the longitudinal portion of the primary sealed sheath and extends radially toward the inside of the primary sealed sheath, the primary support ring having an inner edge attached to the sealed pipe all around the sealed pipe.

Such a sealed pipe may serve for various functions, for example to collect the liquefied gas from the interior space of the tank or to inject the liquefied gas into the interior space, in particular a vapor phase into a top portion of the tank or a liquid phase into a bottom portion of the tank.

According to one embodiment, the sealed pipe has a collection end that opens into the tank at an upper portion of the tank in order to collect a vapor phase of the liquefied gas. Such a pipe for collecting the vapor phase in the tank can be provided with a relatively small diameter, for example less than 300 mm, and in particular less than 100 mm.

According to one embodiment, the other end of the sealed pipe is connected to a gas dome of the tank and/or to a main vapor collector of the installation and/or to overpressure valves of the tank.

According to one embodiment, the tank wall is a ceiling wall. Such a pipe for collecting the vapor phase in the tank can be provided at different locations in the upper portion of the tank, in particular in the vicinity of a longitudinal edge and/or of a lateral edge of the ceiling wall of the tank.

The load-bearing structure can be realized in different ways, in particular in the form of an onshore construction, in the form of a transportable self-supporting metal casing, or in the form of a floating structure.

Thus, the invention also proposes a floating structure, in particular a methane tanker, having a double hull and an abovementioned installation installed in the double hull, wherein the load-bearing structure of the installation is formed by internal walls of the double hull.

According to embodiments, such a floating structure may have one or more of the following features.

According to one embodiment, the tank wall is a ceiling wall and the load-bearing wall is an intermediate deck of the floating structure, the floating structure also having an upper deck parallel to and spaced apart from the intermediate deck, the sealed pipe also having an upper portion extending above the coaming as far as the upper deck and through an opening in the upper deck, a sleeve made of insulating material being arranged around said upper portion between the coaming and the upper deck.

According to one embodiment, the floating structure also has an accordion-like compensator that extends along the upper portion of the pipe above the upper deck and has a lower end joined to the upper deck around the opening in the upper deck and an upper end joined to the sealed pipe all around the sealed pipe, the compensator serving to close the opening in the upper deck in a sealed manner around the sealed pipe, allowing thermal contraction of the sealed pipe.

According to one embodiment, the floating structure is a ship intended to transport liquefied gas, such as a methane tanker or a ship for transporting LPG for example. According to another embodiment, the ship is a ship propelled by drive means supplied by the vapor phase of the liquefied gas. These embodiments can be combined.

According to one embodiment, the floating structure is an inshore or offshore barge, a floating storage regasification unit (FSRU) or a floating production storage and offloading (FPSO) unit.

According to one embodiment, the invention also provides a method for loading or offloading from such a floating structure, wherein a liquefied gas is passed through insulated pipelines from or to a floating or onshore storage installation to or from a tank of the floating structure.

According to one embodiment, the invention also provides a system for transferring a cryogenic fluid, the system having the abovementioned floating structure, insulated pipelines arranged so as to connect the tank installed in the double hull to a floating or onshore storage installation and a pump for conveying a flow of cryogenic fluid through the insulated pipelines from or to the floating or onshore storage installation to or from the tank of the floating structure.

BRIEF DESCRIPTION OF THE FIGURES

The invention will be understood better and further aims, details, features and advantages thereof will become more clearly apparent from the following description of a number of particular embodiments of the invention, which are given solely by way of illustration and without limitation, with reference to the appended drawings.

DETAILED DESCRIPTION OF EMBODIMENTS

Figure 1:
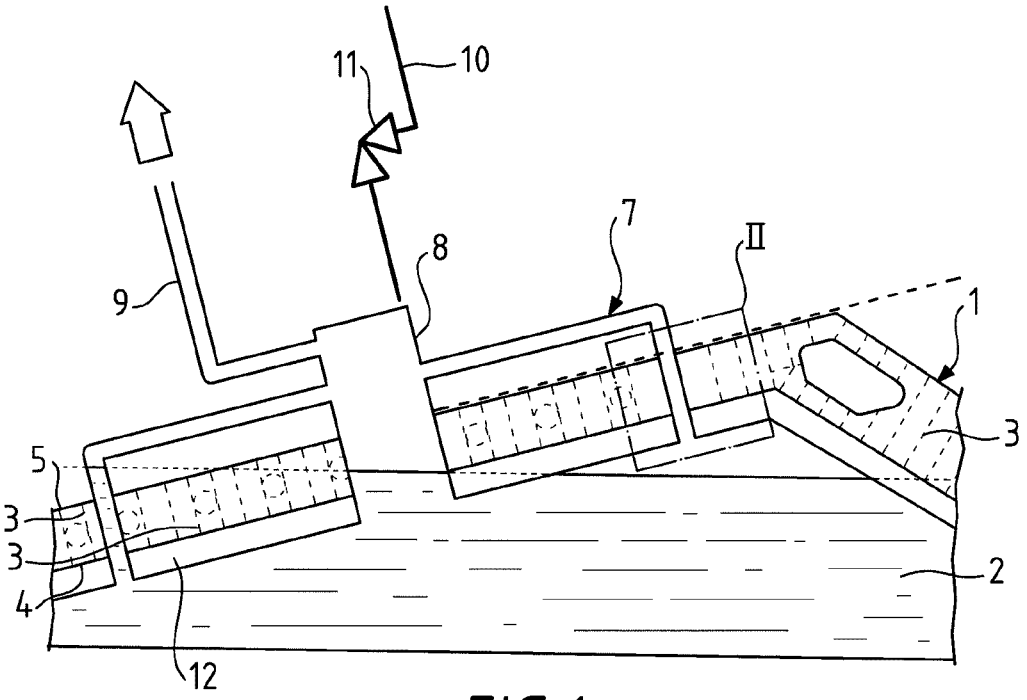
FIG. 1 is a partial cross-sectional view of a tank of a ship for transporting liquefied natural gas, equipped with pipes for evacuating vapor passing through the ceiling wall of the tank and the upper decks of the ship.

With reference to FIG. 1, a ship hull 1 inclined at a list angle is partially shown, in which there is incorporated a sealed and thermally insulating tank 2 having a polyhedral overall shape, defined by a ceiling wall, which is the only one visible, a bottom wall, transverse walls and lateral walls, the transverse walls and the lateral walls connecting the bottom wall and the ceiling wall according to the known technique. The tank 2 is intended for example to contain a cargo of liquefied natural gas (LNG) at a pressure close to atmospheric pressure.

The tank 2 has a longitudinal dimension extending in the longitudinal direction of the ship. The tank 2 is bordered at each of its longitudinal ends by a transverse bulkhead (not shown) delimiting a sealed intermediate space known as a cofferdam.

Figure 2:
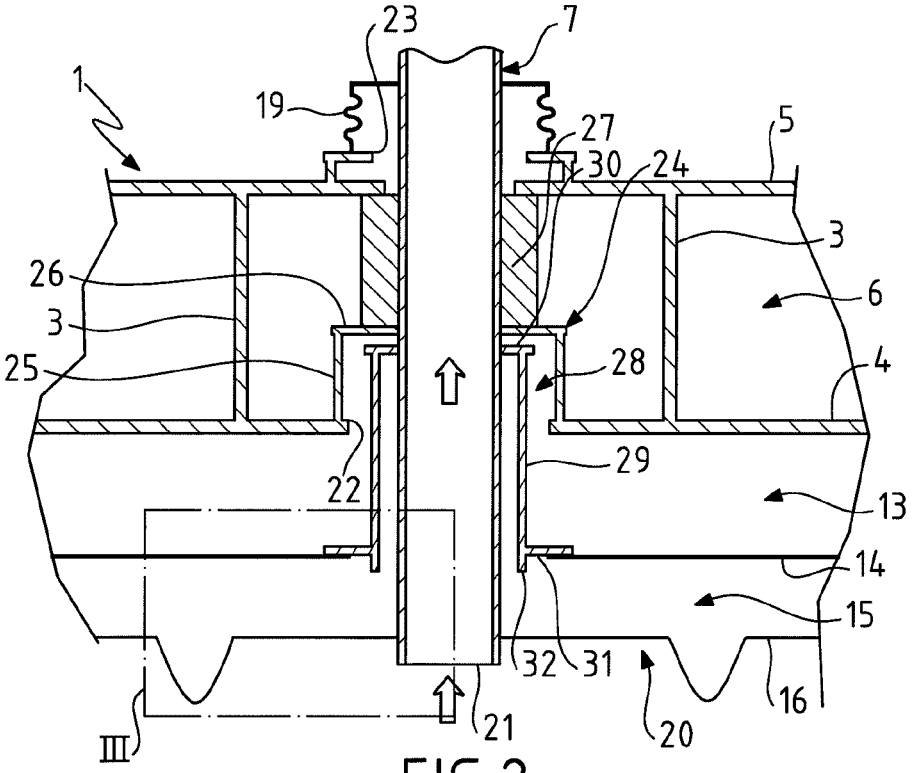
FIG. 2 is an enlarged schematic view of the region II in FIG. 1, according to a first embodiment.

The ship hull 1 is a double hull having an internal hull and an external hull spaced apart by stiffeners 3. In the upper part of the ship, the internal hull is closed by an intermediate deck 4 and the external hull is closed by an upper deck 5, which are spaced apart by an inter-deck space 6, more clearly visible in FIG. 2.

A sealed pipe 7 provided for evacuating the vapor phase in an inclination situation connects the interior space of the tank 2 to a gas dome 8, which is itself connected to a main vapor collector circuit 9 and to a riser mast 10 by way of an overpressure valve 11. To this end, the sealed pipe 7 passes through a wall of the tank, in this case the ceiling wall 12. The function of such a pipe for evacuating the vapor phase is described in more detail in the publication WO-A-2016120540.

With reference to FIGS. 2 to 9, the structure of the tank wall and of the load-bearing structure and the location at which they are passed through by the sealed pipe 7 will now be described in more detail. This location is indicated by the frame II in FIG. 1.

Each wall of the tank 2, in this case the ceiling wall 20, has, from the outside to the inside of the tank, a secondary thermally insulating barrier 13, a secondary sealing membrane 14 carried by the secondary thermally insulating barrier 13, a primary thermally insulating barrier 15, and a primary sealing membrane 16 carried by the primary thermally insulating barrier 15 and intended to be in contact with the liquefied natural gas contained in the tank.

According to one embodiment, the tank wall is produced using the Mark III technology, which is described in particular in the document FR-A-2691520. In such a tank, the thermally insulating barriers 13, 15 and the secondary sealing membrane 14 are substantially made up of juxtaposed panels on the internal surface of the load-bearing wall, in this case the intermediate deck 4. The secondary sealing membrane 14 is formed of a composite material having a sheet of aluminum sandwiched between two sheets of fiberglass fabric. For its part, the primary sealing membrane 16 is obtained by assembling a plurality of metal plates, which are welded together along their edges and have corrugations extending in two perpendicular directions. The metal plates are made, for example, of sheets of stainless steel or aluminum, shaped by bending or stamping.

Further details about such a corrugated metal membrane are described in particular in FR-A-2861060.

The pipe 7 is in this case a stainless steel tube, typically circular with a diameter of less than 100 mm, which extends perpendicularly to the ceiling wall 20 through the entire thickness of the ceiling wall 20 and the double hull 1 so as to connect the interior space of the tank 2 to equipment situated on the upper deck of the ship. The pipe 7 has an internal end 21, which is open and leads into the interior space of the tank 2 in the immediate vicinity of the primary sealing membrane 16.

The pipe 7 extends through an opening in the primary sealing membrane 16 and through an opening in the secondary sealing membrane 14, which are closed in a sealed manner all around the pipe 7, as will be described below.

The pipe 7 extends through an opening 22 in the intermediate deck 4 with a spacing and through an opening 23 in the upper deck 5 with a spacing. It is known that the load-bearing structure of a floating structure is liable to deform in swell, in particular by bending along the longitudinal axis. In order to isolate the pipe 7 from the effects of these deformations, the pipe 7 is supported by the intermediate deck 4 in the region of a coaming 24, which makes it possible to offset the mechanically-welded connection of the pipe 7 at a distance from the intermediate deck 4.

The height of the coaming is much lower than the height of the inter-deck space 6, and for example between 10 and 20 cm.

Like the double hull 1, the coaming 24 is a mechanically-welded metal structure, made for example of stainless steel. It has a lateral wall 25 forming an outwardly protruding turret welded to the intermediate deck 4 around the opening 22, and a top wall 26 welded to the upper end of the lateral wall 25. The top wall 26 has an opening through which the pipe 7 passes, for example at the center of the top wall 26, and the edge of which is welded all around the pipe 7, in order to take up the weight of the pipe 7. At sea, the coaming 24 deforms in a similar manner to a ball joint in response to the bending of the intermediate deck 4 and makes it possible to limit the movement of the pipe 7.

The internal hull forms preferably a liquid- and gastight envelope around the tank, including at the intermediate deck 4 and the coaming 24.

Above the upper deck 5, the pipe 7 is surrounded by an accordion-like compensator 19, which connects the peripheral surface of the pipe 7 to the outer surface of the upper deck 5 in a sealed manner, while allowing a variation in length of the pipe 7 under the effect of variations in temperature in service.

An insulating sleeve 27 is disposed around the pipe 7 in the inter-deck space 6 in order to limit thermal leaks. Similarly, an insulating filling 28 is arranged in the coaming 24, beyond the secondary thermally insulating barrier 13, in order to limit thermal leaks. Suitable materials for the insulating sleeve 27 and the insulating filling 28 are in particular glass wool, polyurethane foam and the like.

A secondary sealing sheath 29, made for example of stainless steel, is arranged around the pipe 7 and extends through the thickness of the tank wall from a support ring 30 fixed around the pipe 7 in the coaming 24 as far as the secondary sealing membrane 14, which is connected by a tight bond to a connecting plate 31 fixed at the periphery of the secondary sealed sheath 29. The connecting plate 31 extends radially on the outside of the secondary sealed sheath 29. Preferably, the support ring 30 is disposed in the upper half of the coaming 24.

The primary sealing membrane 16, for its part, is welded in a sealed manner around the pipe 7 beyond the internal end 32 of the secondary sealed sheath 29.

The structure of the tank wall around the pipe 7 and the secondary sealed sheath 29 will now be described in more detail with reference to FIGS. 3 to 6.

Figure 3:
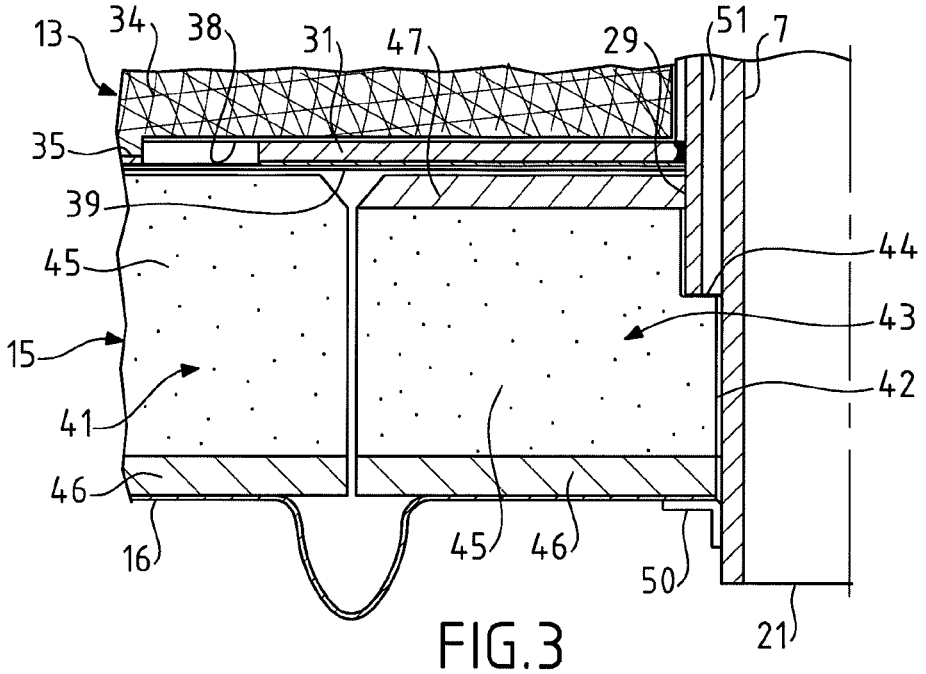
FIG. 3 is an enlarged view of the region III in FIG. 2.
Figure 4:
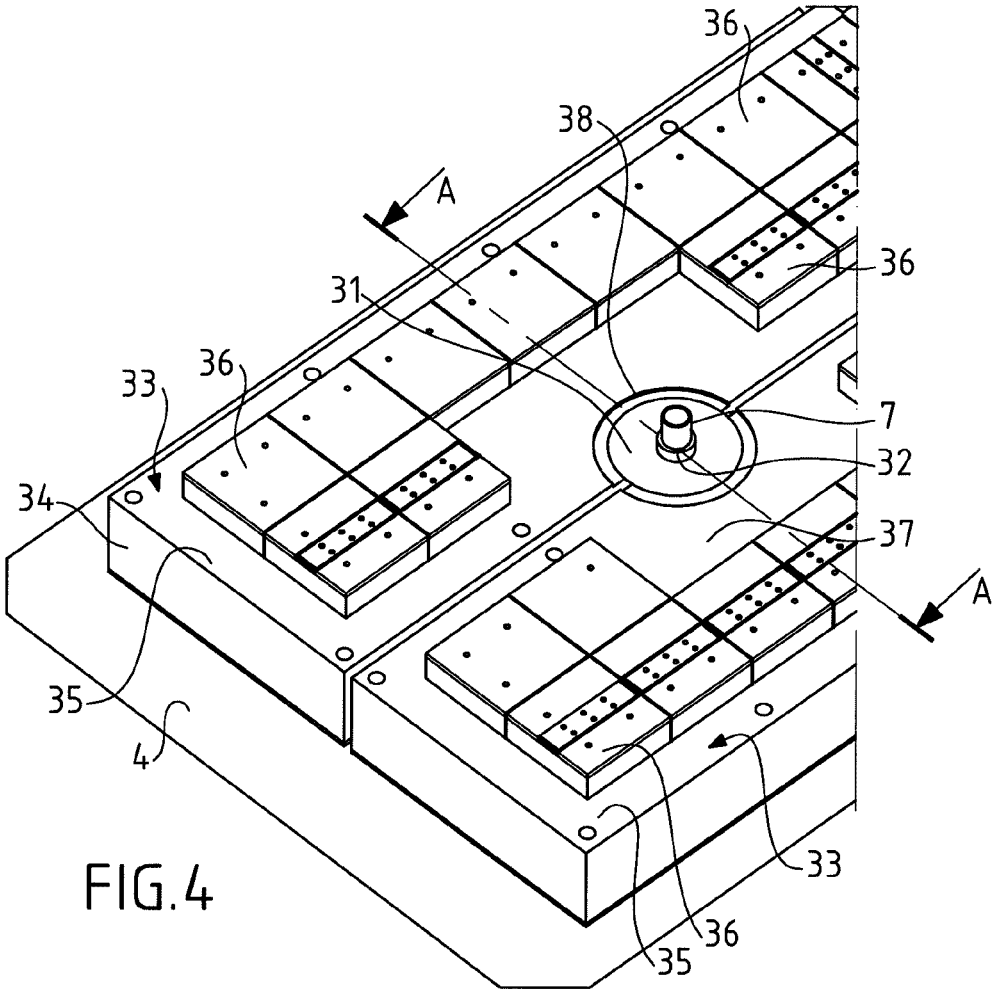
FIG. 4 is a partial perspective view of a region of the tank wall surrounding the evacuation pipe, before the closure of the secondary sealing membrane.

FIG. 4 shows two prefabricated rectangular panels 33 disposed on the inner surface of the intermediate deck 4 on either side of the pipe 7, such that the secondary sealed sheath 29 is housed in a cutout made in a longitudinal edge of each of the rectangular panels 33 halfway along the latter. FIG. 4 also shows the section plane A-A corresponding to FIG. 3.

According to the known technique, a rectangular panel 33 has a secondary insulating block 34, a composite secondary membrane element 35 bonded to the secondary insulating block 34, and primary insulating slabs 36 bonded to the composite secondary membrane element 35, apart from at a peripheral rim and in a clearance zone 37 around the secondary sealed sheath 29.

The rectangular panel 33 also has a, for example circular, spot face 38 in the clearance zone 37, for accommodating the connecting plate 31 carried by the secondary sealed sheath 29. The spot face 38 interrupts the composite secondary membrane element 35 at a distance from the secondary sealed sheath 29.

Figure 5:
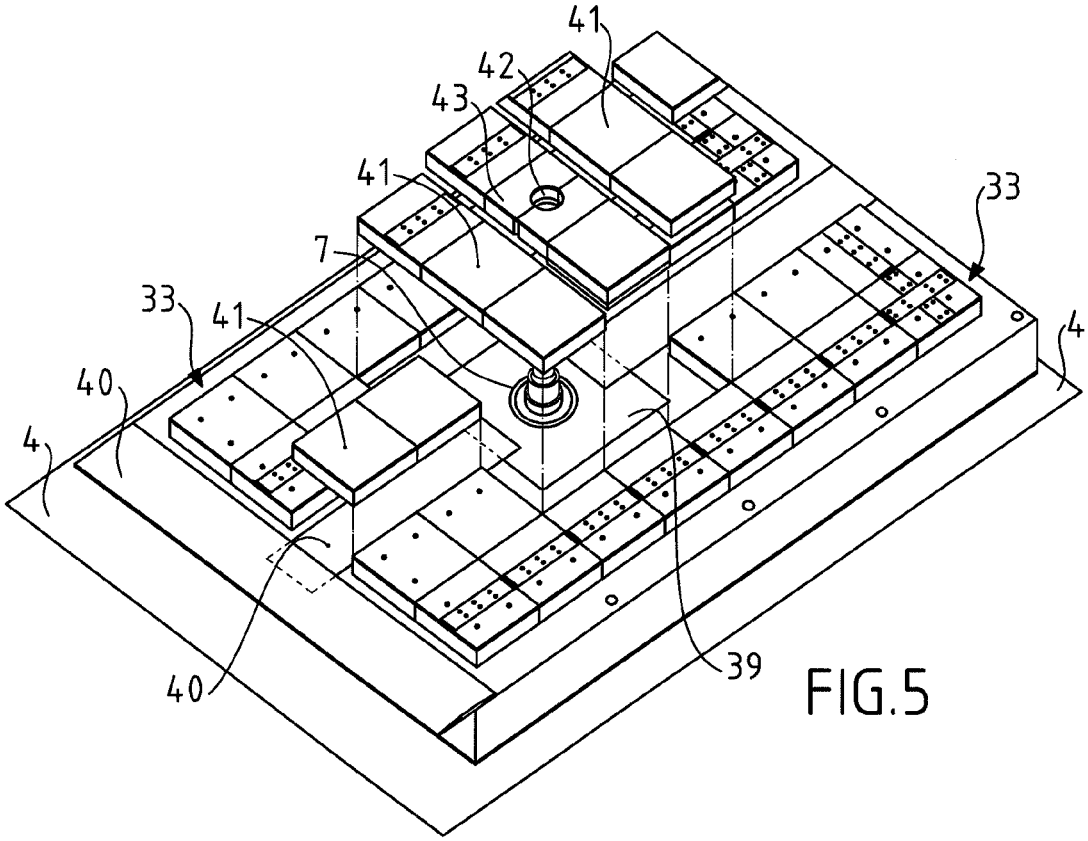
FIG. 5 is a view similar to FIG. 4, showing the secondary sealing membrane and the primary insulating barrier.

As can be seen in FIG. 5, a sealed composite ply part 39 is bonded in a straddling manner to the connecting plate 31 and the composite secondary membrane elements 35 all around the secondary sealed sheath 29 so as to ensure the continuity of the secondary sealing membrane 14. Strips of sealed composite ply 40 are also bonded at the gaps between two rectangular panels 33, according to the known technique.

FIG. 5 also shows, in an exploded perspective view, complementary insulating slabs 41, which are bonded after completion of the secondary sealing membrane 14 to the rims of the rectangular panels 33 and in the clearance zone 37 in order to complete the primary thermally insulating barrier 15.

Two apertured half-slabs 43 are employed around the pipe 7. Each of these has a semicircular cutout 42 in a longitudinal edge for housing the pipe 7. A shoulder 44 formed in the semicircular cutout 42, visible in FIG. 3, covers the end 32 of the secondary sealed sheath 29.

As can be seen in FIG. 3, the apertured half-slab 32, like the insulating slab 41, has a block of insulating foam 45 and a cover plate 46.

A bottom plate 47 made of rigid material, for example plywood, can also be provided on the apertured half-slab 43 in order to stiffen it, as illustrated. The other insulating slabs 41 exhibit better stiffness on account of the larger size and the lack of a cutout. A bottom plate (not shown) can also be provided therein.

Figure 6:
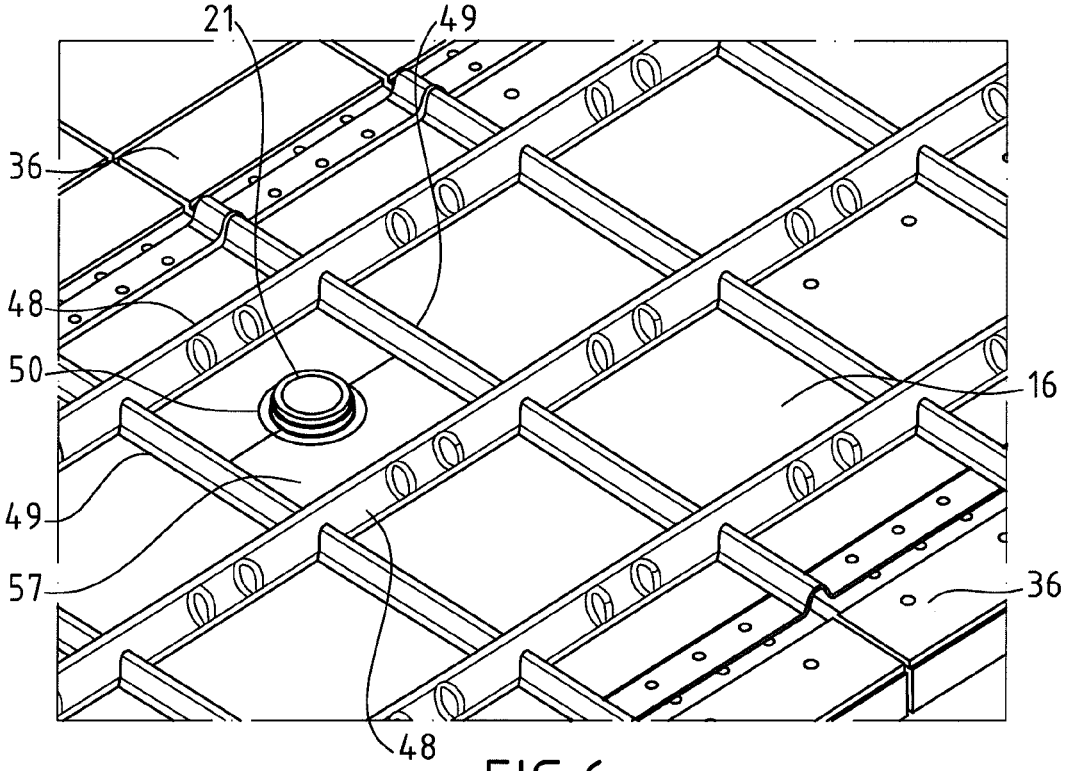
FIG. 6 is a partial perspective view of a region of the tank wall surrounding the evacuation pipe, showing the primary sealing membrane.

FIG. 6 shows the primary sealing membrane 16 around the pipe 7. The primary sealing membrane is formed of metal plates having corrugations 48 and 49 extending in two perpendicular directions. As can be seen, the end 21 of the pipe 7 passes through a flat region 57 of the primary sealing membrane that is situated between the corrugations 48 and 49 and provided with a corresponding opening. A flanged ring 50 is welded both to the edge of the metal plates around the opening and to the periphery of the pipe 7 in order to ensure sealing.

The spacing between two corrugations 48 or two corrugations 49 is for example between 400 and 600 mm, in particular 510 mm.

As can be seen in FIG. 3, a gap 51 between the pipe 7 and the secondary sealed sheath 29 can be left empty or filled with an insulating lining.

Figure 7:
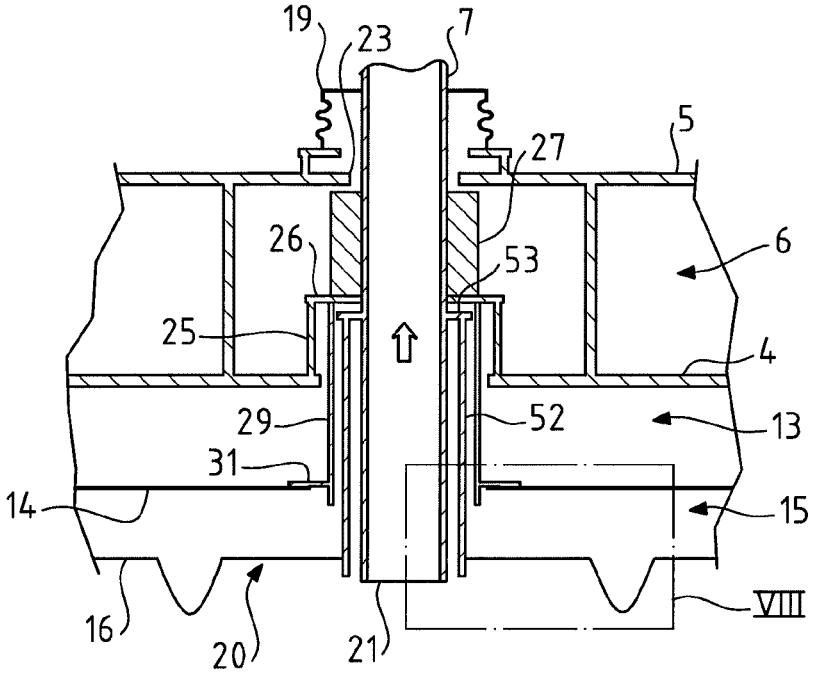
FIG. 7 is an enlarged schematic view of the region II in FIG. 1, according to a second embodiment.
Figure 9:
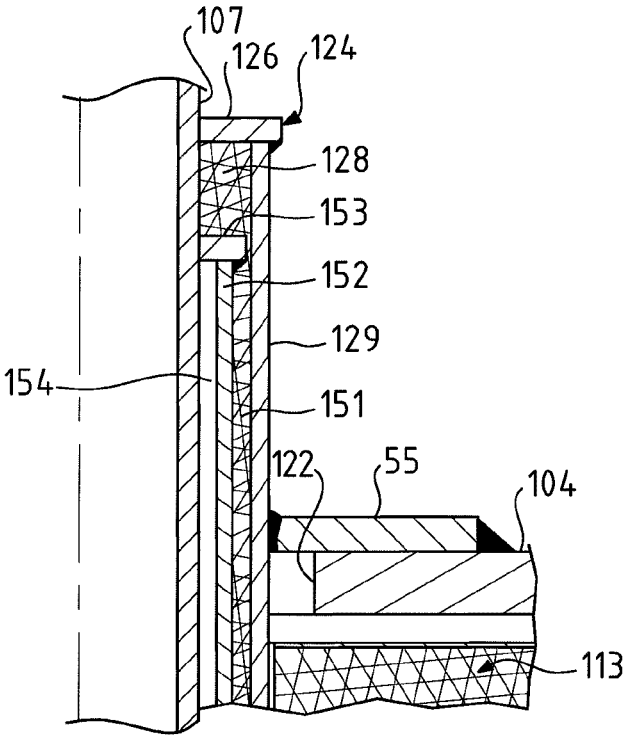
FIG. 9 is an enlarged partial view of the region II in FIG. 1, according to a third embodiment.

Various possibilities exist for joining the secondary sealed sheath 29 to the load-bearing structure. In the embodiment in FIG. 2, the secondary sealed sheath 29 is joined to the pipe 7 by the support ring 30. FIG. 7 shows an embodiment in which the secondary sealed sheath 29 is welded to the top wall 26 of the coaming 24. FIG. 9 shows an embodiment in which the secondary sealed sheath 129 directly constitutes the lateral wall of the coaming 124.

In these two latter cases, it is apparent that the coaming 24 forms part of the secondary sealing barrier, at least at the top wall 26 situated radially on the inside of the secondary sealed sheath 29. The coaming 24 therefore has to be sealed at least at the top wall 26. Similarly, the coaming 124 entirely forms the secondary sealing barrier. The coaming 124 therefore has to be entirely sealed.

Figure 8:
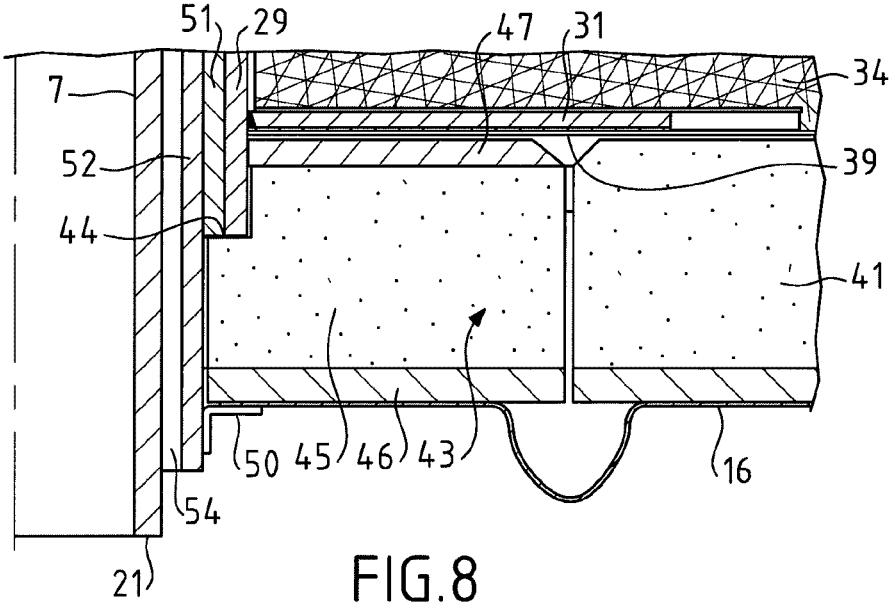
FIG. 8 is an enlarged view of the region VIII in FIG. 7.

With reference to FIGS. 7 to 8, a second embodiment of the tank wall around the pipe 7 will now be described. Elements that are identical or similar to those in the first embodiment bear the same reference numeral as in FIGS. 2 to 6 and will not be described again.

This second embodiment employs a primary sealed sheath 52 that is interposed between the secondary sealed sheath 29 and the pipe 7 and serves to close the primary sealing membrane 16 without being directly connected to the pipe 7. The primary sealed sheath 52 makes it possible to further decouple the primary sealing membrane 16 from any movements that the pipe 7 may undergo in service under the effect of the thermal contraction and/or under the effect of the flow that it carries.

As in the case of the secondary sealed sheath 29, various possibilities exist for joining the primary sealed sheath 52 to the load-bearing structure. In the embodiment in FIG. 7, the primary sealed sheath 52 is joined to the pipe 7 by the support ring 53. The primary sealed sheath 52 could also be extended as far as the top of the coaming.

As can be seen in FIG. 8, the flanged ring 50 is welded both to the edge of the metal plates around the opening and to the periphery of the primary sealed sheath 52 in order to ensure sealing. The gap 54 between the pipe 7 and the primary sealed sheath 52 is in communication with the interior space of the tank 2. The gap 51 between the secondary sealed sheath 29 and the primary sealed sheath 52 is in this case filled with an insulating lining.

With reference to FIG. 9, a third embodiment of the tank wall around the pipe will now be described. Elements that are identical or similar to those in the first embodiment bear the same reference numeral as in FIGS. 2 to 6 increased by 100 and will not be described again.

The third embodiment makes it possible to further simplify the structure by using one and the same metal sheath both as the secondary sealed sheath 129 and as the lateral wall of the coaming 124. In other words, the secondary sealed sheath 129 is joined to the intermediate deck 104 around the opening 122, without a significant offset apart from the thickness of a connecting flat 55. This embodiment is suitable in particular for applications in which the deformations of the load-bearing structure are more limited.

In one dimensioning example, the wall thickness of the pipe 7 and of the or each sealed sheath 29, 52, 129, 152 is between 5 mm and 12 mm.

The above-described structures are easily adaptable to tank walls in which the thermally insulating barriers are more or less thick. In a simplified embodiment, for example for a liquefied gas less cold than LNG, the secondary sealing membrane and the secondary sealed sheath are eliminated and the tank wall has a single thermally insulating barrier surmounted by a single metal sealing membrane.

Further details about the number and the position of the pipes for evacuating the vapor phase and about the collection installation for the vapor situated outside the tank and to which such pipes can be connected are described in the publication WO-A-2016120540.

The structures described above with reference to a pipe for evacuating the vapor phase and to a ceiling wall of the tank can be used for other pipes, in particular small-diameter pipes, that need to pass through any wall of a sealed and thermally insulating tank.

Figure 10:
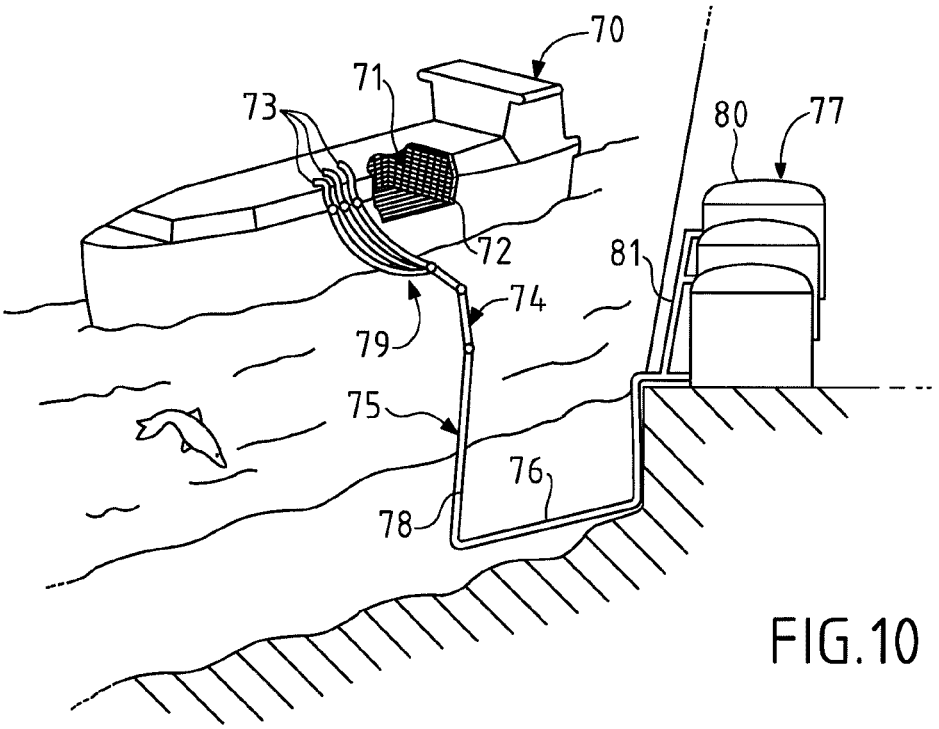
FIG. 10 is a cutaway schematic depiction of a ship having a tank for storing liquefied natural gas and of a terminal for loading/offloading from this tank.

With reference to FIG. 10, a cutaway view of a methane tanker 70 equipped with such an installation for storing and transporting liquefied natural gas can be seen. FIG. 10 shows a sealed and insulated tank 71 with a prismatic overall shape mounted in the double hull 72 of the ship.

In a manner known per se, loading/offloading pipelines 73 disposed on the upper deck of the ship can be connected, by means of appropriate connectors, to a maritime or port terminal in order to transfer a cargo of liquefied natural gas from or to the tank 71.

FIG. 10 also shows an example of a maritime terminal having a loading and offloading station 75, an underwater pipe 76 and an onshore installation 77. The loading and offloading station 75 is an offshore fixed installation having a movable arm 74 and a tower 78 supporting the movable arm 74. The movable arm 74 carries a bundle of insulated flexible hoses 79 that can be connected to the loading/offloading pipelines 73. The orientable movable arm 74 adapts to all sizes of methane tanker. A connecting pipe (not shown) extends inside the tower 78. The loading and offloading station 75 makes it possible to load and offload from the methane tanker 70 from or to the onshore installation 77. The latter has liquefied gas storage tanks 80 and connecting pipes 81 connected to the loading or offloading station 75 by the underwater pipe 76. The underwater pipe 76 makes it possible to transfer the liquefied gas between the loading or offloading station 75 and the onshore installation 77 over a large distance, for example 5 km, making it possible to keep the methane tanker 70 at a large distance from the coast during the loading and offloading operations.

In order to generate the pressure necessary for transferring the liquefied gas, use is made of pumps on board the vessel 70 and/or pumps with which the onshore installation 77 is equipped and/or pumps with which the loading and offloading station 75 is equipped.

Although the invention has been described in connection with a number of particular embodiments, it is obvious that it is in no way limited thereby and that it comprises all the technical equivalents of the means described and the combinations thereof where these fall within the scope of the invention.

The use of the verb "have", "comprise" or "include" and of the conjugated forms thereof does not exclude the presence of elements or steps other than those set out in a claim. The use of the indefinite article "a/an" or "one" for an element or a step does not, unless stated otherwise, rule out the presence of a plurality of such elements or steps.

In the claims, any reference sign between parentheses should not be interpreted as limiting the claim.

The invention claimed is:

1. An installation for storing and transporting a liquefied gas, the installation having:

a load-bearing structure having a load-bearing wall provided with an opening, a sealed and thermally insulating tank incorporated in said load-bearing structure, said sealed and thermally insulating tank having a tank wall mounted on an inner surface of the load-bearing wall, the tank wall having at least one thermally insulating barrier and at least one sealing membrane that are superposed in a thickness direction of the tank wall, a sealed metal pipe that is fitted in the opening in the load-bearing wall and passes through the tank wall parallel or obliquely to said thickness direction so as to define a fluid passage between the inside and the outside of the tank, a sealed metal sheath that is disposed around the sealed pipe and fitted in the opening in the load-bearing wall, the sealed sheath having a longitudinal portion extending parallel to the sealed pipe through the thickness of the thermally insulating barrier at least as far as the sealing membrane, the sealing membrane having an opening through which the sealed pipe passes and being joined to the sealed sheath in a sealed manner all around said opening, wherein the load-bearing structure comprises a coaming that protrudes from an outer surface of the load-bearing wall and is disposed around the sealed pipe, the sealed pipe being supported by a top wall of the coaming, and the longitudinal portion of the sealed sheath having an outer end that is disposed outside the load-bearing wall and attached to the top wall of the coaming or to the sealed pipe in a sealed manner, all around the sealed pipe.

2. The installation as claimed in claim 1, wherein the longitudinal portion of the sealed sheath constitutes a lateral wall of the coaming, the longitudinal portion of the sealed sheath being welded to the load-bearing wall around the opening in the load-bearing wall, the top wall of the coaming being fixed to the outer end of said longitudinal portion.

3. The installation as claimed in claim 1, wherein the sealed sheath also has a support ring that is fixed at the outer end of the longitudinal portion of the sealed sheath and extends radially toward the inside of the sealed sheath, the support ring having an inner edge attached to the sealed pipe all around the sealed pipe.

4. The installation as claimed in claim 3, wherein the support ring is disposed in an outer half of the coaming.

5. The installation as claimed in claim 1, wherein the sealing membrane is a metal membrane that is welded to the sealed sheath in a sealed manner by way of a flanged ring.

6. The installation as claimed in claim 5, wherein the metal membrane has a series of parallel corrugations spaced apart at a regular pitch, the opening in the sealing membrane through which the sealed pipe passes having dimensions smaller than the regular pitch and being disposed in a flat region of the metal membrane between two corrugations.

7. The installation as claimed in claim 1, wherein the tank wall has a primary sealing membrane intended to be in contact with the liquefied gas, a secondary sealing membrane arranged between the primary sealing membrane and the load-bearing wall, a secondary thermally insulating barrier arranged between the secondary sealing membrane and the load-bearing wall, and a primary thermally insulating barrier arranged between the secondary sealing membrane and the primary sealing membrane.

8. The installation as claimed in claim 7, wherein said sealed sheath has a connecting plate extending in the region of the secondary sealing membrane all around the longitudinal portion of the sealed sheath, the secondary sealing membrane having a composite ply bonded to the connecting plate in a sealed manner all around the opening in the secondary sealing membrane.

9. The installation as claimed in claim 8, wherein a filling of insulating material is arranged in a gap between the longitudinal portion of the sealed sheath and the sealed pipe.

10. The installation as claimed in claim 8, wherein the primary sealing membrane has an opening for the sealed pipe to pass through, an edge of said opening being joined to the sealed pipe in a sealed manner all around the sealed pipe.

11. The installation as claimed in claim 8, wherein said sealed metal sheath is a secondary sealed sheath and the installation also has a primary sealed metal sheath that is disposed around the sealed pipe between the sealed pipe and the secondary sealed sheath, the primary sealed sheath having a longitudinal portion extending parallel to the sealed pipe through the thickness of the thermally insulating barrier at least as far as the primary sealing membrane, the primary sealing membrane having an opening through which the sealed pipe and the primary sealed sheath pass and being joined to the primary sealed sheath in a sealed manner all around said opening.

12. The installation as claimed in claim 11, wherein a filling of insulating material is arranged in a gap between the longitudinal portion of the secondary sealed sheath and the longitudinal portion of the primary sealed sheath.

13. The installation as claimed in claim 1, wherein the sealed pipe has a collection end that opens into the tank at an upper portion of the tank in order to collect a vapor phase of the liquefied gas.

14. The installation as claimed in claim 1, wherein the tank wall is a ceiling wall.

15. A floating structure having a double hull and an installation as claimed in claim 1 installed in the double hull, wherein the load-bearing structure of the installation is formed by internal walls of the double hull.

16. The floating structure as claimed in claim 15, wherein the tank wall is a ceiling wall and the load-bearing wall is an intermediate deck of the floating structure, the floating structure also having an upper deck parallel to and spaced apart from the intermediate deck, the sealed pipe also having an upper portion extending above the coaming as far as the upper deck and through an opening in the upper deck, a sleeve made of insulating material being arranged around said upper portion between the coaming and the upper deck.

17. The floating structure as claimed in claim 16, also having an accordion-like compensator that extends along the upper portion of the pipe above the upper deck and has a lower end joined to the upper deck around the opening in the upper deck and an upper end joined to the sealed pipe all around the sealed pipe, the compensator serving to close the opening in the upper deck in a sealed manner around the sealed pipe, allowing thermal contraction of the sealed pipe.

18. A system for transferring a liquefied gas, the system having a floating structure as claimed in claim 15, insulated pipelines arranged so as to connect the tank installed in the double hull to a floating or onshore storage installation and a pump for conveying a flow of cryogenic fluid through the insulated pipelines from or to the floating or onshore storage installation to or from the tank of the floating structure.

19. A method for loading or offloading from a floating structure as claimed in claim 15, wherein a liquefied gas is passed through insulated pipelines from or to a floating or onshore storage installation to or from a tank of the floating structure.

20. A floating structure according to claim 15, wherein the floating structure is a methane tanker.

* * * * *